US005440224A

United States Patent [19]

Kimura

[11] Patent Number: 5,440,224

[45] Date of Patent: Aug. 8, 1995

[54] REFERENCE VOLTAGE GENERATING CIRCUIT FORMED OF BIPOLAR TRANSISTORS

[75] Inventor: Katsuji Kimura, Tokyo, Japan

[73] Assignee: NEC Corporation, Tokyo, Japan

[21] Appl. No.: 342,008

[22] Filed: Nov. 16, 1994

Related U.S. Application Data

[63] Continuation of Ser. No. 9,631, Jan. 27, 1993, abandoned.

[30] Foreign Application Priority Data

Jan. 29, 1992 [JP] Japan ..... 4-038521

[51] Int. Cl.[6] ..... G05F 3/16

[52] U.S. Cl. ..... 323/313; 323/315

[58] Field of Search ..... 323/313, 314, 312, 315

[56] References Cited

U.S. PATENT DOCUMENTS

| | | | |
|---|---|---|---|
| 4,808,909 | 2/1989 | Eddlemon | 323/313 |
| 5,034,677 | 7/1991 | Ito et al. | 323/315 |
| 5,038,053 | 8/1991 | Djenguerian | 307/310 |
| 5,144,223 | 9/1992 | Gillingham | 323/313 |
| 5,173,656 | 12/1992 | Seevinck et al. | 323/314 |
| 5,175,489 | 12/1992 | Mizuide | 323/315 |
| 5,180,967 | 1/1993 | Yamazaki | 323/315 |
| 5,221,889 | 6/1993 | Carvajal | 323/315 |

FOREIGN PATENT DOCUMENTS

| | | |
|---|---|---|
| 0264563A1 | 4/1988 | European Pat. Off. . |
| 2186453 | 8/1987 | United Kingdom . |

OTHER PUBLICATIONS

New Developments in IC Voltage Regulators, by Robert J. Widlar, IEEE Journal of Solid-State Circuits, vol. SC-6, No. 1, Feb. 1971, pp. 2-7.

*Primary Examiner*—Peter S. Wong
*Assistant Examiner*—Adolf Berhane
*Attorney, Agent, or Firm*—Burns, Doane, Swecker & Mathis

[57] ABSTRACT

A reference voltage generating circuit comprising a first and second transistors whose base-to-emitter voltages are different from each other and a constant current source to drive said respective transistors. Since the base-to-emitter voltages are different from each other, the circuit scarcely has a temperature characteristic with a reduced circuit scale. The first and second transistors preferably have different emitter areas. The current source is preferably a current mirror circuit composed of third and fourth transistors whose emitter areas are different from each other to drive the first and second transistors by different currents.

3 Claims, 5 Drawing Sheets

REFERENCE VOLTAGE GENERATING CIRCUIT FORMED OF BIPOLAR TRANSISTORS

This application is a continuation, of application Ser. No. 08/009,631, filed Jan. 27, 1993, now abandoned.

BACKGROUND OF THE INVENTION

1. Field of the Invention

This invention relates to a reference voltage generating circuit and more particularly, to a reference voltage generating circuit formed of bipolar transistors, which is used for a constant voltage circuit.

2. Description of the Prior Art

As a reference voltage generating circuit formed of bipolar transistors, conventionally, the Widlar bandgap voltage reference shown in FIG. 1 is well known and has been put to practical use. The circuit in FIG. 1 comprises a constant current source CS (constant current I) disposed on the side of a power source (supply voltage V+) and three npn-type bipolar transistors Q71, Q72 and Q73.

The transistor Q71 has an emitter directly connected to the earth, a collector connected through a first resistor (resistance R71) to the current source CS and a base connected to the collector thereof. The collector and the base of the transistor Q71 are connected in common to a base of the transistor Q72.

The transistor Q72 has an emitter connected through a third resistor (resistance R73) to the earth and a collector connected through a second resistor (resistance R72) to the current source CS.

The transistor Q73 has an emitter connected directly to the earth and a collector connected directly to the current source CS.

A reference voltage $V_{ref}$ is outputted from an end to which the collectors of the transistors Q71, Q72 and Q73 and the current source CS are connected in common.

The operating principle of the Widlar voltage reference shown in FIG. 1 is as follows:

If the base-to-emitter voltage of the transistor Q73 is expressed as $V_{BE}$, the difference of the base-to-emitter voltages of the transistors Q71 and Q72 is expressed as $\Delta V_{BE}$, the reference voltage $V_{ref}$ to be outputted is expressed as follows:

$$V_{ref}=V_{BE}+(R72/R73)\cdot\Delta V_{BE} \quad (1)$$

In the other hand, if Boltzmann's constant is k, absolute temperature is T and a charge of an electron is q, the voltage difference $\Delta V_{BE}$ is expressed as follows:

$$\Delta V_{BE}=(kT/q)\cdot 1n(J_1/J_2)$$

where J1 and J2 are current densities of the transistors Q71 and Q72, respectively.

Thus the reference voltage $V_{ref}$ is expressed as follows:

$$V_{ref}=V_{BE}+(R72/R73)\cdot(kT/q)\cdot\ln(J_1/J_2) \quad (3)$$

In the Widlar bandgap voltage reference described above, the ratio of the current densities ($J_1/J_2$) changes in response to the ambient temperature, so that the reference voltage $V_{ref}$ has such a temperature characteristic as shown in FIG. 2. In addition, since the circuit requires the constant current source CS and the controlling transistor Q73, the circuit is inclined to be large in scale.

SUMMARY OF THE INVENTION

Thus, an object of this invention is to provide a reference voltage generating circuit formed of bipolar transistors which is less in a temperature characteristic than the conventional circuit described above.

Another object of this invention is to provide a reference voltage generating circuit which is smaller in circuit scale than the conventional circuit described above.

A reference voltage generating circuit of this invention comprises a first and second bipolar transistors whose base-to-emitter voltages are different from each other, and a constant current source for driving the first and second transistors.

Preferably, the first and second bipolar transistors have emitter areas different from each other, and the constant current source has two output ends connected to collectors of the first and second transistors respectively. In this case, preferably, the emitters of the first and second transistors are connected to each other, the base and collector of the first transistor are connected to each other and the collector of the first transistor is connected to the base of the second transistor.

Preferably, in at least one of a portion between the base of the first transistor and the current source and a portion between the base and collector of the first transistor, a resistor is provided. An output terminal is provided at the output end connected to the collector of the first transistor.

A resistor may be connected to the emitter of the second transistor.

The constant current source is preferably a current mirror circuit composed of two bipolar transistors whose emitter areas are different from each other.

With the reference voltage generating circuit of this invention, the first and second transistors whose base-to-emitter voltages are different from each other are driven by the constant current source, so that the circuit can be less in a temperature characteristic than the conventional reference voltage generating circuit.

In addition, since a current mirror circuit can be used as the constant current source and is not required such a controlling transistor as the conventional reference voltage generating circuit, the circuit can be reduced in circuit scale.

DESCRIPTION OF THE PREFERRED EMBODIMENTS

Preferred embodiments of this invention will be described below while referring to FIGS. 3, 4, 5, 6, 7 and 8.

[First Embodiment]

Figure 1:
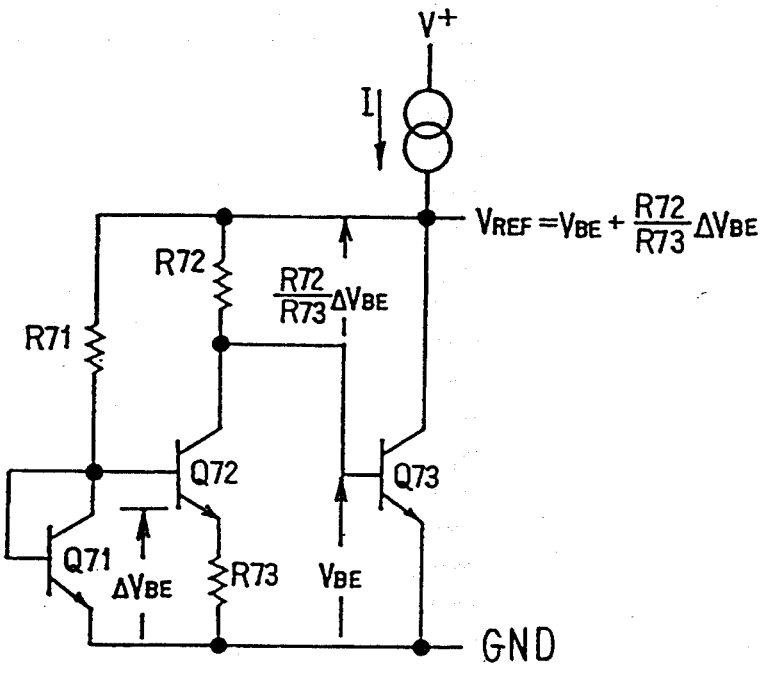
FIG. 1 PRIOR ART
FIG. 1 is a circuit diagram of a conventional reference voltage generating circuit.
Figure 2:
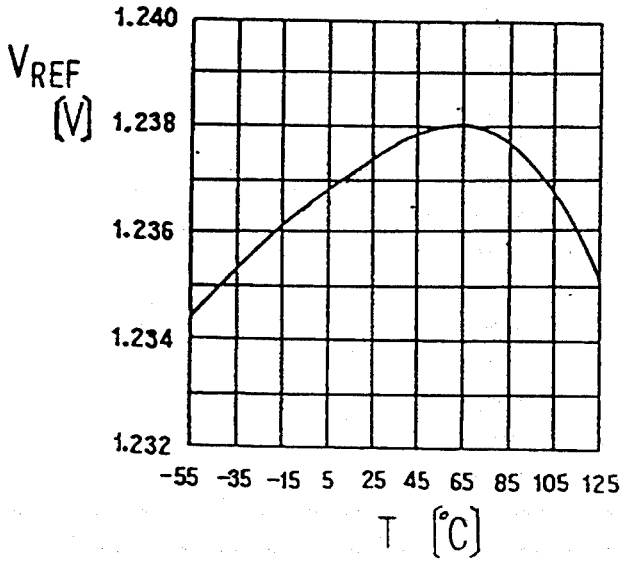
FIG. 2 PRIOR ART
FIG. 2 is a graph showing the temperature characteristic of the circuit in FIG. 1.
Figure 3:
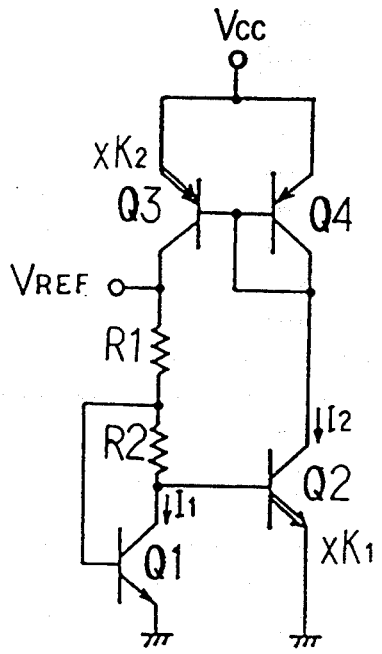
FIG. 3 is a circuit diagram of a reference voltage generating circuit according to a first embodiment of this invention.

FIG. 3 shows a reference voltage generating circuit according to a first embodiment of this invention, which comprises two npn-type bipolar transistors Q1 and Q2 provided on the earth side, and two pnp-type bipolar transistors Q3 and Q4 as a constant current source provided on the side of a direct current (DC) power source (supply voltage $V_{CC}$. It will be understood from FIG. 3 that the circuit of this invention is made much simpler than the conventional reference voltage generating circuit in FIG. 1 to be reduced in circuit scale.

The emitters of the transistor Q1 and Q2 are directly connected in common to the earth. The collector of the transistor Q1 is connected to the collector of the transistor Q3 through a first resistor (resistance R1) and a second resistor (resistance R2) serially connected to each other. The collector of the transistor Q1 is also connected through the second resistor to the base of the transistor Q1 and directly to the base of the transistor Q2. An output terminal is provided at a connecting end of the first resistor and the collector of the transistor Q3. The collector of the transistor Q2 is connected to the collector of the transistor Q4.

Emitter areas of the transistors Q1 and Q2 are different from each other and the emitter area of the transistor Q2 is $K_1$ times as large as that of the transistor Q1, where $K_1 > 1$.

The emitters of the transistors Q3 and Q4 are directly connected to a DC power source (supply voltage $V_{CC}$) in common and the bases thereof are connected to each other. The base and collector of the transistor Q4 are connected to each other.

Emitter areas of the transistors Q3 and Q4 are also different from each other and the emitter area of the transistor Q3 is $K_2$ times as large as that of the transistor Q4.

The transistors Q3 and Q4 constitute a current mirror circuit which drives the transistors Q1 and Q2 at a current ratio of $K_2$:1, respectively, where $K_2 > 1$.

Next, the operation of the reference voltage generating circuit of the embodiment will be described below.

If base-to-emitter voltages of the transistors Q1 and Q2 are expressed as $V_{BE1}$ and $V_{BE2}$ respectively and the difference voltage of the base-to-emitter voltages $V_{BE1}$ and $V_{BE2}$ is expressed as $\Delta V_{BE}$, a reference voltage $V_{REF}$ to be outputted is expressed as follows:

$$V_{ref} = V_{BE1} + (R1/R2) \cdot \Delta V_{BE} \quad (4)$$

In the current mirror circuit formed of the transistors Q3 and Q4, the collector current of the transistor Q3 is $K_2$times as large as that of the transistor Q4. Thus if the collector currents of the transistor Q1 and Q2 are expressed as $I_1$ and $I_2$ respectively, such a relation as $I_1 = K2 \cdot I_2$ is established. Besides, if the saturation currents of the transistor Q1 and Q2 are expressed as $I_{S1}$ and $I_{S2}$ respectively, such a relation as $K1 \cdot I_{S1} = I_{S2}$ is established because the emitter area of the transistor Q1 is $K_1$ times as large as that of the transistor Q2.

Therefore, the difference $\Delta V_{BE}$ of the base-to-emitter voltages is expressed as follows:

$$\begin{aligned} \Delta V_{BE} &= VBE1 - VBE2 \\ &= (kT/q) \cdot \ln(I_1/I_{S1}) - (kT/q) \cdot \ln(I_2/I_{S2}) \\ &= (kT/q) \cdot \ln(K_1 \cdot K_2) \end{aligned} \quad (5)$$

where k is Boltzmann's constant, T is absolute temperature and q is a charge of an electron, Thus the reference voltage $V_{REF}$ can be obtained as follows:

$$V_{REF} = V_{BE1} + (R1/R2) \cdot (kT/q) \cdot \ln(K1 \cdot K2) \quad (6)$$

The temperature characteristic of the reference voltage $V_{REF}$ is expressed as follows:

$$dV_{REF}/dT = dV_{BE1}/dT + (R1/R2) \cdot (k/q) \cdot \ln(K1 \cdot K2) \quad (7)$$

If the temperature characteristics of the first and second resistors are the same, the resistance ratio of the resistors, or (R1/R2), has no temperature characteristic, and since $K_1$ and $K_2$ expresses the emitter area ratios, $K_1$ and $K_2$ also have no temperature characteristic. In other hand, as known well, the base-to-emitter voltage $V_{BE1}$ of the transistor Q1 has a temperature characteristic of about −2 mV/deg and the thermal voltage (kT/q) has a temperature characteristic of 3333 ppm/deg. Accordingly, if the resistances R1 and R2 and the emitter area ratios K1 and K2 are set so that the temperature characteristic of the voltage $V_{BE1}$ cancels the temperature characteristic of the thermal voltage in equation (6), or, the right side of the equation (7) is to be zero, the reference voltage $V_{REF}$ which is not influenced by the ambient temperature can be obtained.

For example, if $V_{BE1} = 0.6$ V, $V_{REF} = 1.2$ V, the following equation is established.

$$(R1/R2) \cdot \ln(K1 \cdot K2) = 23.08$$

The temperature characteristic of the voltage $V_{BE1}$ has excellent linearity, so that the fluctuation of the reference voltage $V_{REF}$ due to the temperature becomes extremely small.

Figure 7:
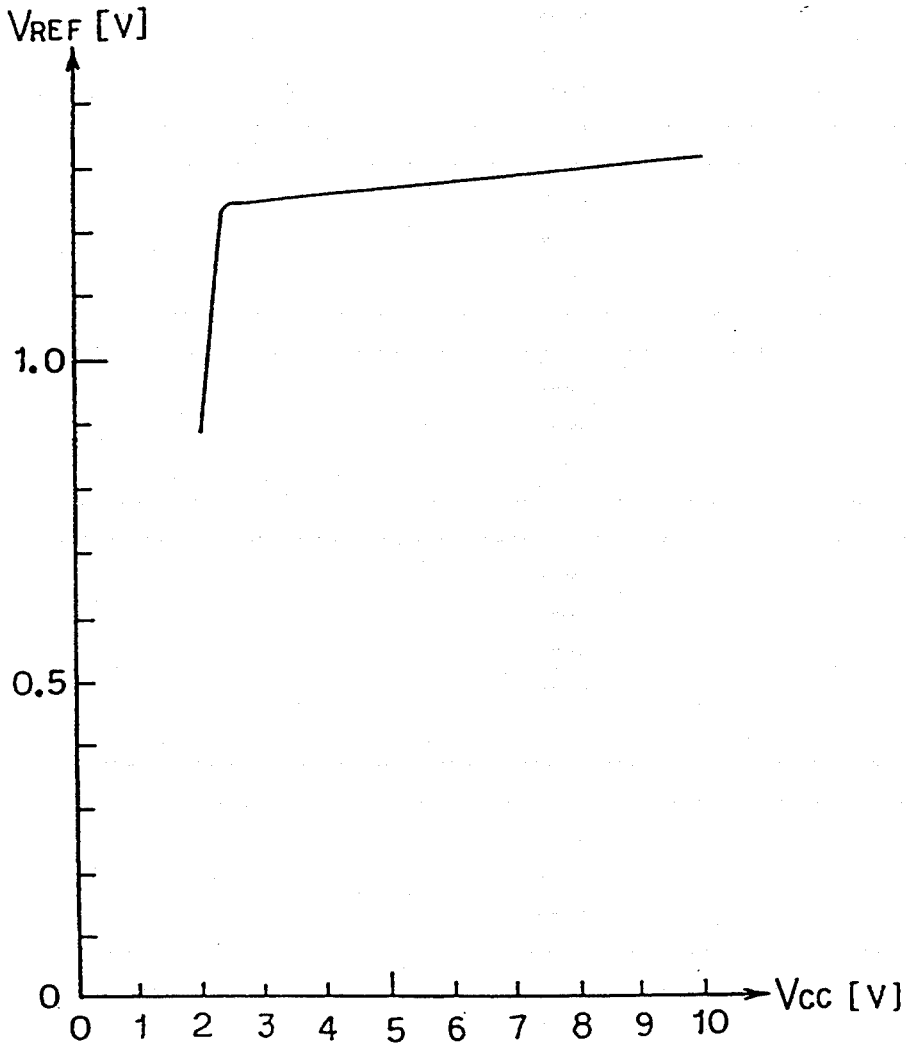
FIG. 7 is a graph showing the input-output characteristic of the circuit in FIG. 3.
Figure 8:
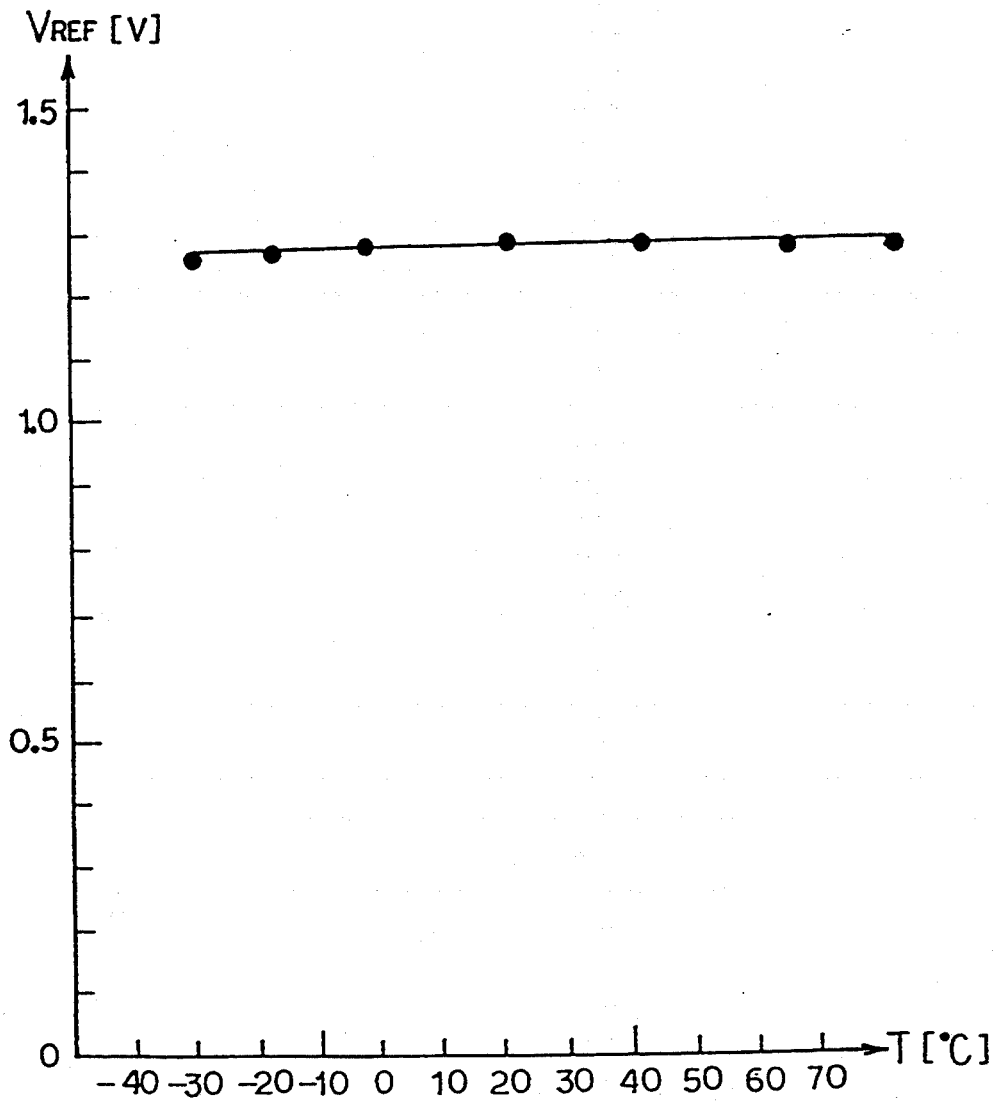
FIG. 8 is a graph showing the temperature characteristic of the circuit in FIG. 3.

FIGS. 7 and 8 show the input-output characteristic and the temperature characteristic of the reference voltage generating circuit according to the embodiment, respectively. FIGS. 7 and 8 were obtained by measuring on the condition that 2SC2785 transistors were used as the transistors Q1 and Q2, 2SB810 transistors were used as the transistors Q3 and Q4, R1=8k Ω, R2=500Ω, $K_1 = 5$ and $K_2 = 1$.

It will be understood from FIG. 7 that the reference voltage $V_{REF}$ changes linearly in response to the power source voltage $V_{CC}$ as an input voltage in the range of the voltage $V_{CC}$ being greater than about 2.5 V. In addition, it will also be understood from FIG. 8 that the reference voltage $V_{REF}$ is substantially constant in the wide temperature range so that the voltage $V_{REF}$ scarcely has a temperature characteristic.

[Second Embodiment]

Figure 4:
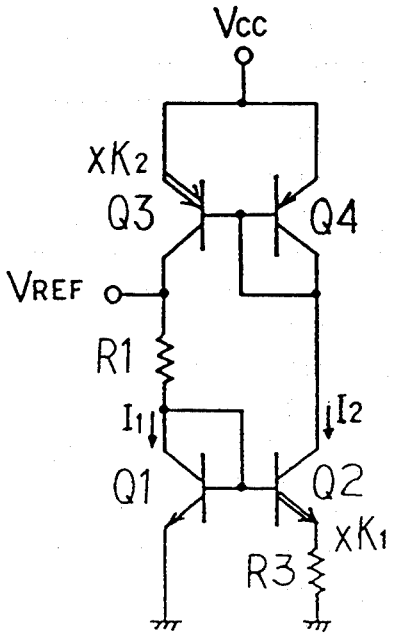
FIG. 4 is a circuit diagram of a reference voltage generating circuit according to a second embodiment of this invention.
Figure 5:
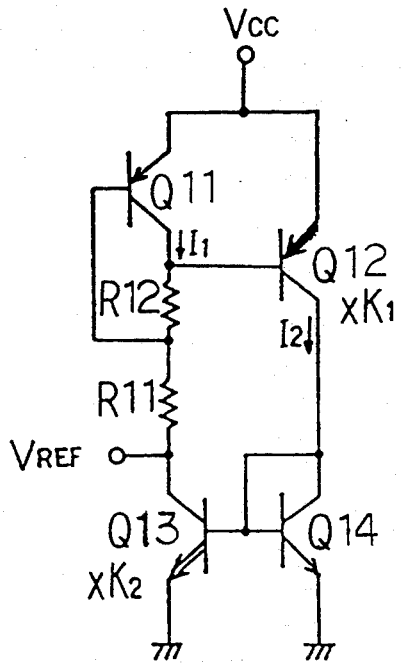
FIG. 5 is a circuit diagram of a reference voltage generating circuit according to a third embodiment of this invention.

FIG. 4 shows a reference voltage generating circuit according to a second embodiment of this invention. This circuit has the same configuration as that of the first embodiment other than that the collector and base of the transistor Q1 are connected directly to each other without the second resistor (resistance R2), and a third resistor (resistance R3) is connected between the emitter of the transistor Q2 and the earth.

The operation of the circuit of this embodiment is the same as that of the first embodiment, however, it is impossible to analyze the operation using such equations as in the first embodiment because the third resistor is connected to the emitter of the transistor Q2. Thus the operation was analyzed by computer simulation and as a result, it was found that the circuit of the second embodiment could have the same characteristics as the first embodiment.

[Third Embodiment]

FIG. 4 shows a reference voltage generating circuit according to a third embodiment of this invention, which includes two pnp-type transistors Q11 and Q12 in place of the npn-type transistors Q1 and Q2 in the first embodiment, and two npn-type transistors Q13 and Q14 in place of the pnp-type transistors Q3 and Q4 therein. The transistors Q11 and Q12 are provided on the side of the DC power source (supply voltage $V_{CC}$) and the transistors Q13 and Q14 are provided on the earth side.

The emitters of the transistors Q11 and Q12 are directly connected to the power source in common. The collector of the transistor Q11 is connected to the collector of the transistor Q13 through a first resistor (resistance R11) and a second resistor (resistance R12) serially connected to each other. The collector of the transistor Q11 is also connected through the second resistor to the base of the transistor Q11, and directly connected to the base of the transistor Q12. The collector of the transistor Q12 is connected to the collector of the transistor Q14.

Emitter areas of the transistors Q11 and Q12 are different from each other and the emitter area of the transistor Q12 is $K_1$ times as large as that of the transistor Q11.

The emitters of the transistors Q13 and Q14 are directly connected to the earth and the bases thereof are connected to each other.

Emitter areas of the transistors Q13 and Q14 are also different from each other and the emitter area of the transistor Q13 is $K_2$ times as large as that of the transistor Q14.

The transistors Q13 and Q14 constitute a current mirror circuit which drives the transistors Q11 and Q12 at a current ratio of K2:1, respectively.

The operation of the circuit of this embodiment is expressed by the same equations as those in the first embodiment and as a result, the same effect as the first embodiment can be obtained.

[Fourth embodiment]

Figure 6:
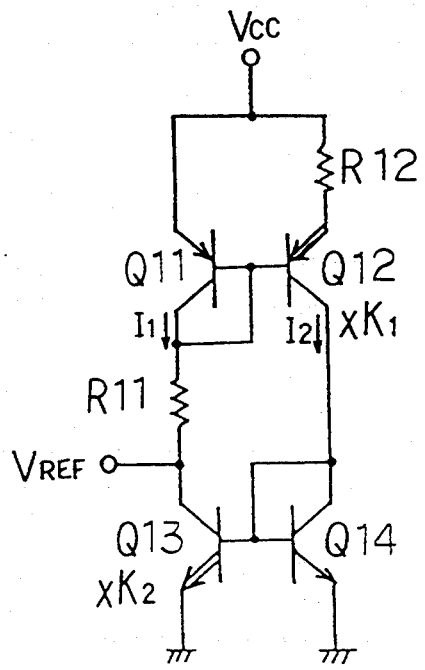
FIG. 6 is a circuit diagram of a reference voltage generating circuit according to a fourth embodiment of this invention.

FIG. 6 shows a reference voltage generating circuit according to a fourth embodiment of this invention. This circuit has the same configuration as that of the third embodiment other than that the collector and base of the transistor Q11 are connected directly to each other without the second resistor (resistance R12), and a third resistor (resistance R13) is connected between the emitter of the transistor Q12 and the earth.

The operation of the circuit of this embodiment is the same as that of the third embodiment, however, it is impossible to analyze the operation using such equations as in the first embodiment because the third resistor is connected to the emitter of the transistor Q12. Thus the operation was analyzed by computer simulation and as a result, it was found that the circuit of the fourth embodiment could have the same characteristics as the first embodiment.

In the above-mentioned embodiments, a current mirror circuit is used as a constant current source, however, other constant current circuit than the current mirror circuit may be used. In addition, two resistors are provided in the embodiments, however, three resistors may be provided, for example, a resistor may be connected to the emitter of the transistor Q2 in the first embodiment.

What is claimed is:

1. A reference voltage generating circuit comprising:

a first bipolar transistor;

a second bipolar transistor whose emitter area is $K_1$ times as large as that of said first transistor, where $K_1 > 1$;

a first resistor connected to an emitter of said second transistor, said emitter of said second transistor being connected to an emitter of said first transistor through said first resistor;

a constant current source for driving said first transistor and said second transistor, said constant current source being a current mirror circuit comprising a third bipolar transistor and a fourth bipolar transistor;

a collector of said first transistor being connected to a collector of said third transistor through a second resistor;

said collector of said first transistor being connected directly to a base of said first transistor and directly to a base of said second transistor;

emitters of said third and fourth transistors being coupled together;

bases of said third and fourth transistors being coupled together;

said base and a collector of said fourth transistor being coupled together;

a collector of said second transistor being connected to said collector of said fourth transistor;

an emitter area of said third transistor being $K_2$ times as large as that of said fourth transistor for driving said first transistor at a driving current $K_2$ times as large as that of said second transistor, where $K_2 > 1$; and an output being derived from a connecting point of said second resistor and said collector of said third transistor.

2. A reference voltage generating circuit comprising:

a first PNP bipolar transistor;

a second PNP bipolar transistor whose emitter area is $K_1$ times as large as that of said first transistor, where $K_1 > 1$;

emitters of said first and second transistors being directly coupled with each other;

a constant current source for driving said first transistor and said second transistor, said constant current source being a current mirror circuit comprising a third bipolar transistor and a fourth bipolar transistor;

a collector of said first transistor being connected to a base of said second transistor and connected to a collector of said third transistor through a first resistor and a second resistor serially connected to each other;

said collector of said first transistor being connected through said first resistor to a base of said first transistor;

emitters of said third and fourth transistors being coupled together;

a collector of said second transistor being connected to said collector of said fourth transistor and to a base of said fourth transistor;

a base of said third transistor being connected directly to said base of said fourth transistor;

an emitter area of said third transistor being $K_2$ times as large as that of said fourth transistor for driving said first transistor at a driving current $K_2$ times as large as that of said second transistor, where $K_2 > 1$; and an output being derived from a connecting point of said second resistor and said collector of said third transistor.

3. A reference voltage generating circuit comprising:

a first PNP bipolar transistor;

a second PNP bipolar transistor whose emitter area is $K_1$ times as large as that of said first transistor, where $K_1 > 1$;

a first resistor connected to an emitter of said second transistor, said emitter of said second transistor being connected to an emitter of said first transistor through said first resistor;

a constant current source for driving said first transistor and said second transistor, said constant current source being a current mirror circuit comprising a third NPN bipolar transistor and a fourth NPN bipolar transistor;

a collector of said first transistor being connected to a collector of said third transistor through a second resistor;

said collector of said first transistor being connected to a base of said first transistor;

said base of said first transistor being connected directly to a base of said second transistor;

emitters of said third and fourth transistors being coupled together;

bases of said third and fourth transistors being coupled together;

said base and a collector of said fourth transistor being coupled together;

a collector of said second transistor being connected to said collector of said fourth transistor;

an emitter area of said third transistor being $K_2$ times as large as that of said fourth transistor for driving said first transistor at a driving current $K_2$ times as large as that of said second transistor, where $K_2 > 1$; and an output being derived from a connecting point of said second resistor and said collector of said third transistor.

* * * * *